United States Patent [19]

Harada et al.

[11] 4,126,107

[45] Nov. 21, 1978

[54] ELECTRONIC FUEL INJECTION SYSTEM

[75] Inventors: Susumu Harada, Oobu; Kunio Endo, Anzyo, both of Japan

[73] Assignee: Nippondenso Co., Ltd., Kariya, Japan

[21] Appl. No.: 720,385

[22] Filed: Sep. 3, 1976

[30] Foreign Application Priority Data

Sep. 8, 1975 [JP] Japan ..... 50/109177

[51] Int. Cl.[2] ..... F02B 3/00

[52] U.S. Cl. ..... 123/32 EH; 123/32 EL; 123/32 EG

[58] Field of Search ..... 123/32 EA, 32 EG, 32 EH, 123/32 EL

[56] References Cited

U.S. PATENT DOCUMENTS

| | | | |
|---|---|---|---|
| 3,673,989 | 7/1972 | Aono et al. | 123/32 EA |
| 3,727,591 | 4/1973 | Suda | 123/32 EH |
| 3,734,067 | 5/1973 | Glockler et al. | 123/32 EG |
| 3,759,231 | 9/1973 | Endo | 123/32 EH |
| 3,796,198 | 12/1974 | Mauch et al. | 123/32 EA |
| 3,858,561 | 1/1975 | Aono | 123/32 EA |
| 4,015,563 | 4/1977 | Drews et al. | 123/32 EH |
| 4,016,843 | 4/1977 | Dorrego | 123/32 EA |
| 4,020,802 | 5/1977 | Hattori et al. | 123/32 EH |

*Primary Examiner*—Charles J. Myhre
*Assistant Examiner*—P. S. Lall
*Attorney, Agent, or Firm*—Edwin E. Greigg

[57] ABSTRACT

An electronic fuel injection system generates primary fuel control pulses in synchronism with the crankshaft rotation. The width of these control pulses is adjusted according to the indications of various engine transducers and determines the amount of fuel to be injected. The system also includes an air flow rate transducer whose output signal is monitored by a comparator. When the air flow rate signal undergoes very rapid changes, the comparator triggers a secondary pulse generator which supplies additional fuel injection control pulses to admit more fuel. The occurrence of the secondary pulses is temporally independent of the primary pulses.

6 Claims, 4 Drawing Figures

ELECTRONIC FUEL INJECTION SYSTEM

BACKGROUND OF THE INVENTION

The invention relates to electrically controlled fuel injection systems for internal combustion engines. More particularly, it relates to fuel injection systems in which injection pulses are generated from information which is obtained in synchronism with crankshaft rotations. The duration of the injection pulses is derived from particular operating conditions of the engine and includes several partial circuits which generates crankshaft-synchronous output pulses which relate to engine parameters and which are fed to logical circuits which alter the pulse durations. The system also includes an air flow rate meter which generates an appropriate signal which is used in the generation of the fuel control pulses.

The known electrical or electronically controlled fuel injection systems have progressed, primarily to reduce cost, from individual injection for each cylinder to the process of simultaneously injecting fuel into all cylinders or induction tubes of the engine, which is now the prevailing practice. In order to improve transient behavior of the engine, it has also been proposed to divide the fuel required by each operating cycle of the engine and to deliver it in two separate injection events. However, even such a division still is incapable of coping with a very rapidly changing air flow rate occurring during a sudden acceleration of the engine. Since fuel is delivered at exact predetermined times, and the quantity of fuel relates to the air flow then occurring, the engine may not receive the proper amount of fuel when the air flow rate changes very rapidly. Thus, in the case of very abrupt accelerations or changes of the aspirated air quantity, the engine torque decreases and it loses power, the driving sensations deteriorate and, if the fuel starvation becomes large enough, it may lead to engine misfires and to a considerable deterioration of the exhaust gas composition. In order to counteract such disadvantages when simultaneous injection to all cylinders is employed,it is possible to shift the point of injection to the time when the rapid change occurs and to feed an amount of fuel to the engine which is based on a fixed pulse width. However, this also invites difficulties because both the amount of fuel as well as the timing of the injection point can be in error and thus the correct amount of fuel may not be fed to the engine at the right time. Thus, if the fuel fed to the engine is not delivered at the exact time of the sudden change in the air flow rate, it may actually be too large for the required conditions which again deteriorates the exhaust gas composition and diminishes the driving comfort. Thus, in a known system, if the acceleration injection signals are associated with the instant at which a throttle valve exceeds a certain opening position, and if the injection takes place at that time, any further acceleration or displacement of the throttle valve would have no effect. It has also been found in tests that, after a rapid change of the aspirated air quantity if fuel is injected at the moment the throttle valve has obtained its maximum opening there may be a considerable deterioration in the engine behavior and in the fuel-air composition. This tendency to deteriorate the engine behavior is especially great in known fuel injection systems if, for example during a gear change, the engine is taken very rapidly from deceleration to acceleration and, more especially, if the system includes a throttle valve damper or a similar mechanism so as to eliminate delaying effects.

OBJECT AND SUMMARY OF THE INVENTION

It is a principal object of the invention to provide an electrically controlled fuel injection system which maintains the proper and satisfactory operation of the engine even when the air flow rate changes very rapidly during, for example, acceleration. It is a further object of the invention to provide a fuel injection system which prevents irregular engine operation or torque decrease during rapid changes in the air flow rate. These and other objects are attained according to the invention by providing the known circuits for generating fuel injection pulses in dependence on prevailing operational parameters of the engine and, in addition thereto, to provide circuitry which senses the occurrence of very rapid changes in the air flow rate and which generates an acceleration signal which is used to provide additional injection pulses of predetermined duration, thereby improving considerably the overall behavior of the engine during accelerations.

Thus, the orderly operation of the engine is maintained even in very complicated accelerating circumstances and the right composition of the fuel-air mixture for good combustion is also insured.

It is a feature of the present invention to provide a timing circuit and to compare the change in the air flow rate with the output of the timing circuit.

The invention will be better understood as well as further objects and advantages thereof become more apparent from the ensuing detailed specification of a preferred embodiment taken in conjunction with the drawing.

DESCRIPTION OF THE PREFERRED EMBODIMENT

Figure 1:
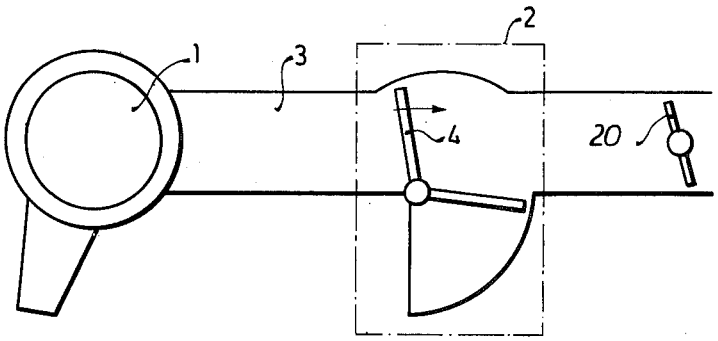
FIG. 1 is a schematic diagram of the induction manifold region of an internal combustion engine.

Turning now to FIG. 1, there will be seen a schematic representation of an air flow rate meter 2 disposed between an air filter 1 and a throttle 20 in an induction tube 3 of an internal combustion engine. The air flow rate meter 2 may include a baffle plate 4 which is displaced in appropriate manner by the air flowing through the induction tube 3 and it is provided with means for generating electrical signals that are related to its position and hence to the aspirated air quantity.

When the engine is accelerated, the air flow rate changes and if the change in the air flow rate is too great or if, more generally, the air flow rate itself exceeds a certain value, the signals from the air flow rate meter are processed in such a way as to provide fuel to the engine in a manner which avoids the disadvantages of the known systems and which maintains satisfactory and flawless engine operation during such transitions. The basic construction of an apparatus according to the invention is illustrated with the help of FIG. 2. Signals proportional to the engine rpm are generated, for example at the primary winding of the ignition coil, and are fed to a pulse former circuit 5 so as to produce pulses of the desired width and amplitude and to eliminate spurious signals. These rpm-synchronous pulses then travel to a frequency divider circuit which performs an appropriate division depending on the number of cylinders. For example, if the engine is a 6-cylinder engine having 6 operating cycles the frequency divider operates in the ratio of 1:3, if the fuel injection by the electromagnetic valves 12 occurs once during each crankshaft revolution. A basic pulse generator 7, triggered by the frequency divider circuit 6, generates the primary pulse $t_p$, its width being determined on the basis of information coming from the air flow rate meter 2. The width $t_p$ of the primary pulse is made proportional to the air flow rate.

Additional circuitry modifies the width of these pulses according to prevailing engine conditions and external circumstances. For example, there is provided a multiplying circuit 8 which receives signals from a throttle position transducer 13, a cooling water temperature sensor 14 and an induction air temperature sensor 15. For example, the multiplier circuit 8 may use this additional information to provide a pulse whose width $t_m = t_p \times (1 + \alpha)$. Preferably the multiplier circuit is so constructed that, if the signals coming from the various sensors are either constant or are within their design range, the value $\alpha$ is equal to 1. Typical design conditions would be that the cooling water temperature lies in a region whose lower limit is 70° C., the aspirated air is at least 20° C. and the throttle valve indicates partial load.

If the current initially flowing into the multiplier circuit 8 is $I_1$, there is provided an additional current, which implies an increase of the pulse width, of the magnitude $I_1 + I_2$. The output pulses from the multiplier circuit 8 and the output pulses from the primary pulse generator 7 are both fed to a summation circuit 10 which may, for example, be an OR gate. The apparatus also includes a voltage correction circuit 9 which takes account of any possible voltage changes, or fluctuations, in the vehicle battery voltage and provides correction pulses $t_u$ which are added on to the trailing edge of the pulses $t_m$ and which are intended to correct any possible erratic excitation of the electromagnetic valve 12 due to these voltage fluctuations. The summation circuit 10, which may be an OR gate, finally produces pulses of width $\tau = t_p + t_m + t_u$ which are fed through a driver circuit 11 to the one or more electromagnetic valves 12. If an OR circuit is used as the summation circuit 10, the pulse generating circuits 7, 8 and 9 are so embodied that their pulses occur in a temporal sequence so that the OR circuit may sum them.

In a substantial characteristic of the present invention, there is provided a circuit 16 which senses the rate of change of the signals generated by the air flow rate meter 2. A further substantial feature of the invention is a correction pulse generator 17 which is controlled by the data from the acceleration sensor 16 and which produces pulses of controlled duration which are also fed to the previously mentioned logical summation circuit 10 and which are intended to energize the electromagnetic fuel injection valves at a time which may differ from the normal actuation time of these valves.

Figure 2:
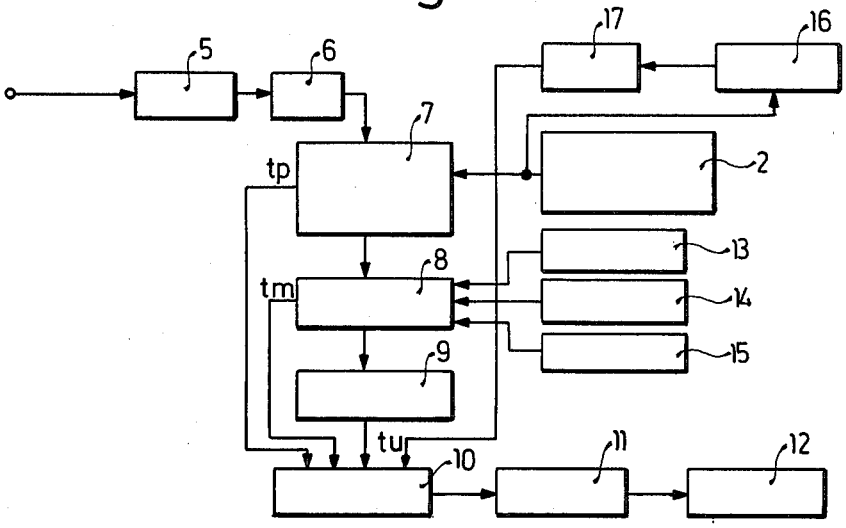
FIG. 2 is a block diagram of a fuel injection system including the additional circuits of the invention.
Figure 3:
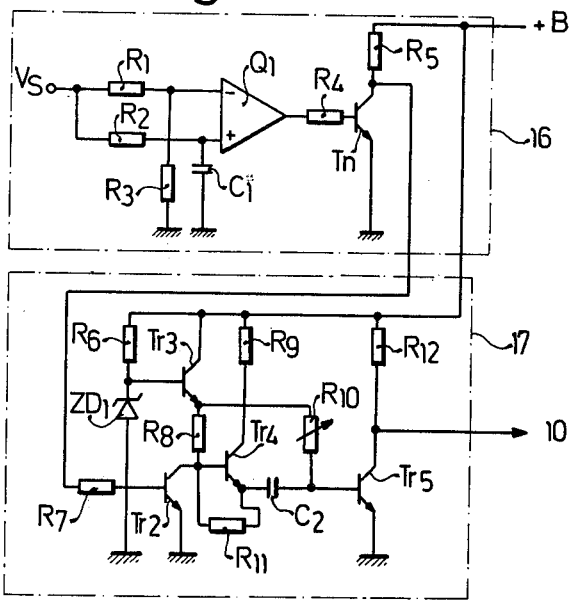
FIG. 3 is a detailed circuit diagram of the additional correction circuitry according to the invention.

The acceleration sensing circuit 16, as well as the correction pulse generator circuit 17, will now be discussed in detail with the aid of FIG. 3. The output signals from the air flow rate meter are labeled V*s*. These pulses are fed simultaneously to the inverting and non-inverting inputs of a comparator amplifier Q1 through resistors R1 and R2, respectively. The inverting input is grounded through a resistor R3 so that the input signal to the inverting input is, in effect, derived from a voltage divider chain. The resistances of resistors R1 and R2 may be changed in any desired manner although, in the present exemplary embodiment, R1 is assumed to be equal to R2. R3 may be dimensioned such that R1 = R2 = R3/10. Since the non-inverting input of the comparator Q1 is grounded through a capacitor C1 of predetermined value, this input experiences a time delay which, however, plays no role once the input signal has settled down to a particular value. However, if this input signal changes, for example due to an acceleration of the vehicle in response to accelerator pedal actuation, the air flow rate signal Vs changes rapidly and this change is immediately transmitted to the inverting input of the comparator Q1 at a value determined by the ratio of resistors R1 and R3. By contrast, the signal at the non-inverting input of the comparator Q1 only gradually approaches the predetermined value at a rate determined by the time constant defined by R2 and C1. Normally, due to the presence of the voltage dividers R1 and R3, the input signal at the inverting input is smaller than that at the non-inverting input so that the output from the comparator will normally be a logical 1. If the input signal changes at a rate exceeding a predetermined value, then the delayed signal increase at the non-inverting input temporarily causes the signal at the inverting input to be the larger signal and, during that time, the output of the comparator Q1 switches over to a logical 0 state. The value of the rate of change of the air signal at which this switchover occurs may be determined by the values of the timing elements R2 and C1. When the comparator output switches to logical 0, the subsequent transistor T*n* blocks providing a triggering pulse to the subsequent correction pulse generator circuit 17. When triggered, this circuit 17 produces an output pulse at the collector of an output transistor Tr5. The duration of the pulse from the transistor Tr5 is determined by a time constant defined by elements R10 and C2 connected to the base of the transistor Tr5. As also shown in FIG. 2, the output pulse from the collector of the transistor Tr5 is fed to the logical summation circuit (OR circuit) which then transmit an appropriate pulse to the output stage 11 for controlling the fuel injection valves 12. The duration of this additional pulse may be adjusted by adjusting the resistor R10.

Figure 4:
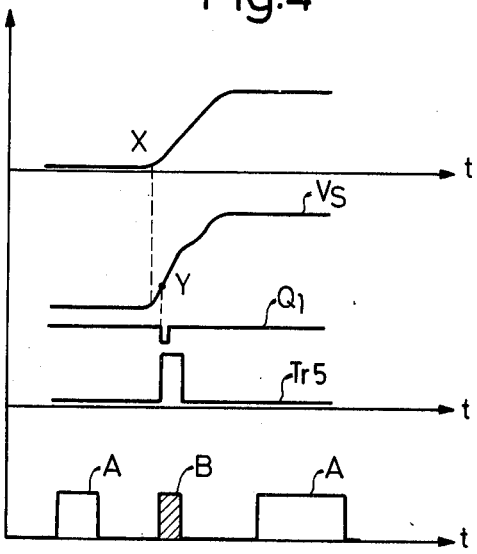
FIG. 4 is a diagram illustrating the signals occurring at various portions of the circuit.

The curves shown in FIG. 4 will be used to illustrate the operation of the circuit according to the invention.

If the accelerating process is assumed to begin at a point X in the upper curve of FIG. 4, the air quantity aspirated by the engine will change according to the first curve.

The second curve shows the output signal V*s* of the air flow rate meter 2. It will be seen that this signal follows a certain characteristic function, including some overshoot, after which it finally approaches its new nominal value. At the point Y, the comparator Q1 switches from an output state 1 to an output state 0 as shown in the curve just below the curve V*s*. The small negative pulse from the comparator Q1 triggers the subsequent correction pulse generator 17 which may be embodied in any suitable form, for example as a flip-flop with adjustable time constant, and its output transistor T*r*5 then generates the additional pulse shown in the curve labeled T*r*5. This pulse, which is a supplementary injection pulse, due only to the occurrence of a rapid change in the air flow rate, is labeled B and is superimposed on the normal fuel injection pulses A.

The system of the present invention is so designed that it delivers at least one supplementary injection pulse of predetermined duration whenever the signals representative of the aspirated air flow rate change at a rate which exceeds a given predetermined value. The additional injection pulses B are generated at an arbitrary time different from the time of occurrence of the normal injection pulses. The system according to the invention, responding at the exact time of the occurrence of an acceleration, is able to adapt the fuel-air ratio to the actual requirements and thus produces an engine operation which is far improved over that provided by known systems. Furthermore, it guarantees that the exhaust gas composition is not changed in a deleterious manner, because a proper fuel-air mixture is always being supplied to the engine.

The foregoing relates to a preferred embodiment of the invention, it being understood that other embodiments and variants are possible within the spirit and scope of the invention, the latter being defined by the appended claims.

What is claimed is:

1. In a fuel injection system for an internal combustion engine, said engine including a crankshaft, an induction tube and at least one electromagnetic fuel injection valve and said fuel injection system including means for generating signals related to engine parameters and means to receive said signals and to generate therefrom primary fuel injection control pulses in synchronism with the rotation of said crankshaft and means for measuring the air flow rate through said induction tube and to generate an electrical datum related thereto, the improvement comprising.

first circuit means, for receiving said datum related to air flow rate and for generating therefrom a trigger signal when the rate of change of said air flow rate exceeds a predetermined value;

second circuit means, for receiving said trigger signal and for generating secondary fuel injection control pulses;

a summing circuit connected directly to said means generating the primary fuel injection control pulses and directly to said second circuit means, for receiving said primary fuel injection control pulses and said secondary fuel injection control pulses; and means, connected to said summing circuit, for actuating said at least one electromagnetic fuel injection valve, wherein said first circuit means includes a timing circuit with a fixed time constant for comparing the time constant of the rate of change of said flow rate signal with said fixed time constant, and said timing circuit includes an operational amplifier having inverting and non-inverting inputs, both inputs being provided with said electrical datum related to the air flow rate through the induction tube, one of said inputs being connected to a resistor and a capacitor to provide time delay action for changes in the input signal; whereby said operational amplifier acts in a manner of a comparator and changes its logical output whenever the rate of change of said input signal is such as to reverse the relative magnitude of the potentials present at said inverting and non-inverting inputs.

2. A fuel injection system as defined by claim 1, wherein said first circuit means includes resistive voltage divider means for reducing the magnitude of said air flow rate datum provided to said inverting input of said operational amplifier and a capacitor connected between the non-inverting input of said operational amplifier and circuit ground and including a further resistor connected between said non-inverting input and the source of said air flow rate datum.

3. A fuel injection system as defined by claim 1, wherein said first and second circuit means are so coupled to said summing circuit that, when primary fuel injection control pulses are absent, a predetermined rate of change of said air flow rate will independently produce said secondary fuel injection control pulses.

4. In a fuel injection system for an internal combustion engine, said engine including a crankshaft, an induction tube and at least one electromagnetic fuel injection valve and said fuel injection system including means for generating signals related to engine parameters and means to receive said signals and to generate therefrom primary fuel injection control pulses in synchronism with the rotation of said crankshaft and means for measuring the air flow rate through said induction tube and to generate an electrical datum related thereto, the improvement comprising:

first circuit means, for receiving said datum related to air flow rate and for generating therefrom a trigger signal when the rate of change of said air flow rate exceeds a predetermined value;

second circuit means, for receiving said trigger signal and for generating secondary fuel injection control pulses;

a summing circuit connected directly to said means generating the primary fuel injection control pulses and directly to said second circuit means, for receiving said primary fuel injection control pulses and said secondary fuel injection control pulses; and means, connected to said summing circuit, for actuating said at least one electromagnetic fuel injection valve, wherein said second circuit means includes a monostable multivibrator connected to be triggered by said first circuit means; whereby the duration of the unstable state of said monostable multivibrator is adjustable and defines the duration of said secondary fuel injection control pulses.

5. A fuel injection system as defined by claim 4, wherein said monostable multivibrator includes a plurality of transistors and timing means provided by a resistor and a capacitor for defining the duration of said secondary fuel injection control pulses.

6. A fuel injection system as defined in claim 4, wherein said first and second circuit means are so coupled to said summing circuit that, when primary fuel injecton control pulses are absent, a predetermined rate of change of said air flow rate will independently produce said secondary fuel injection control pulses.

* * * * *